United States Patent [19]

Chapman et al.

[11] 4,248,566

[45] Feb. 3, 1981

[54] DUAL FUNCTION COMPRESSOR BLEED

[75] Inventors: Dennis C. Chapman, Greenfield; David T. Sayre, Greenwood, both of Ind.

[73] Assignee: General Motors Corporation, Detroit, Mich.

[21] Appl. No.: 949,143

[22] Filed: Oct. 6, 1978

[51] Int. Cl.[3] ..... F01D 17/00

[52] U.S. Cl. ..... 415/26; 415/DIG. 1

[58] Field of Search ..... 415/26, 27, 28, 116, 415/117, 145, 144, DIG. 1; 416/181

[56] References Cited

U.S. PATENT DOCUMENTS

| | | | |
|---|---|---|---|
| 2,837,270 | 6/1958 | Chapman | 415/27 |
| 3,123,285 | 3/1964 | Lee | 415/DIG. 1 |
| 3,217,655 | 11/1965 | Sercy et al. | 415/116 |
| 3,484,039 | 12/1969 | Mittelstaedt | 415/144 |
| 3,887,295 | 6/1975 | Yu | 415/116 |
| 3,893,787 | 7/1975 | Jones | 415/DIG. 1 |

FOREIGN PATENT DOCUMENTS

| | | | |
|---|---|---|---|
| 509180 | 2/1952 | Belgium | 415/116 |
| 591619 | 4/1976 | U.S.S.R. | 415/DIG. 1 |

*Primary Examiner*—Carlton R. Croyle
*Assistant Examiner*—A. N. Trausch, III
*Attorney, Agent, or Firm*—J. C. Evans

[57] ABSTRACT

A centrifugal compressor for a gas turbine turbo-shaft engine includes a stationary shroud cover over the inducer section of an impeller in the centrifugal compressor including a plurality of raised reinforcing bridges at the leading edge of the outer surface of the cover and having an annular control slot formed inboard of the bridges to communicate the inner surface of the shroud cover with surrounding gas and wherein the shroud surrounds an impeller which produces a variable cover static pressure at the point of the control slot so it serves combined functions of causing an inflow of gas from exteriorly of the cover into the impeller to add to the inlet flow to the impeller under high speed conditions of compressor operation and wherein the same slots serve to bleed gas flow from the impeller to a point exteriorly of the compressor at part speeds of rotation of the impeller thereby to flow stabilize the impeller at part speed phases of operation thereof.

3 Claims, 6 Drawing Figures

DUAL FUNCTION COMPRESSOR BLEED

This invention relates to centrifugal and mixed flow compressors for use in gas turbine engines and more particularly to centrifugal compressors including gas bleed in association therewith for regulating the operating characteristics of the compressor.

Operation of impeller diffuser combinations in gas turbine turbo-shaft engines for powering aircraft includes transient maneuvers of the aircraft known as Type 2 waveoffs which can result in compressor surge. Type 2 waveoffs are more specifically ones where there is a snap deceleration from full power in the engine followed immediately by a snap acceleration from near idle speed of the engine. In the past it has been recognized that inadequate surge margin in such compressors could be eliminated by bleeding a substantial percentage of the compressor gas flow through a bleed valve connected to communicate with the compressor discharge scroll. However, such bleed valves can open in the normal operating range of the gas turbine engine and cause the engine to be energy inefficient.

Accordingly, an object of the present invention is to improve the operating efficiency of compressors in gas turbine engines by including dual purpose bleed means therein to move the inducer stall to lower speeds and lower flow conditions in the compressor and moreover to enhance full speed flow capabilities of the compressor.

Another object of the present invention is to provide improved operating efficiency by reduction of inducer stall to lower speed and lower flow conditions while maintaining enhanced full speed flow capabilities through the compressor by including a bleed control slot at a meridional point of the stationary cover over the impeller downstream of the inducer choke point where the compressor impeller produces an in-flow of gas through the slot at compressor speeds near the compressor impeller design speed thereby to add the flow through the control slot to that of the annular inlet area to the impeller to increase total in-flow of gas to the impeller under high speed conditions of operation; and wherein the control slot is operative to bleed gas from the compressor exteriorly thereof at speeds less than design speed of the impeller to flow stabilize the impeller at part speed phases of its operation.

Still another object of the present invention is to provide an improved flow controlled centrifugal compressor for use in gas turbine engines wherein the compressor includes a stationary shroud cover with a control slot located circumferentially therearound at the impeller tip at a particular meridional length aft of the inducer leading edge of the compressor and wherein the slot is sized and located aft of the flow limiting throat restriction in the inducer of the impeller so that under inducer choking conditions the inducer flow limiting restriction of flow is supplemented by in-flow of gas through the control slot to in-bleed sufficient gas through gas bleed aft of the throat restriction to add to the high speed flow capacity of the compressor and wherein the same control slot serves to produce an adequate out-flow of inlet gas flow through the inducer at part speed conditions of operation of the impeller to improve the part speed surge characteristics of the compressor.

Further objects and advantages of the present invention will be apparent from the following description, reference being had to the accompanying drawings wherein a preferred embodiment of the present invention is clearly shown.

Figure 1:
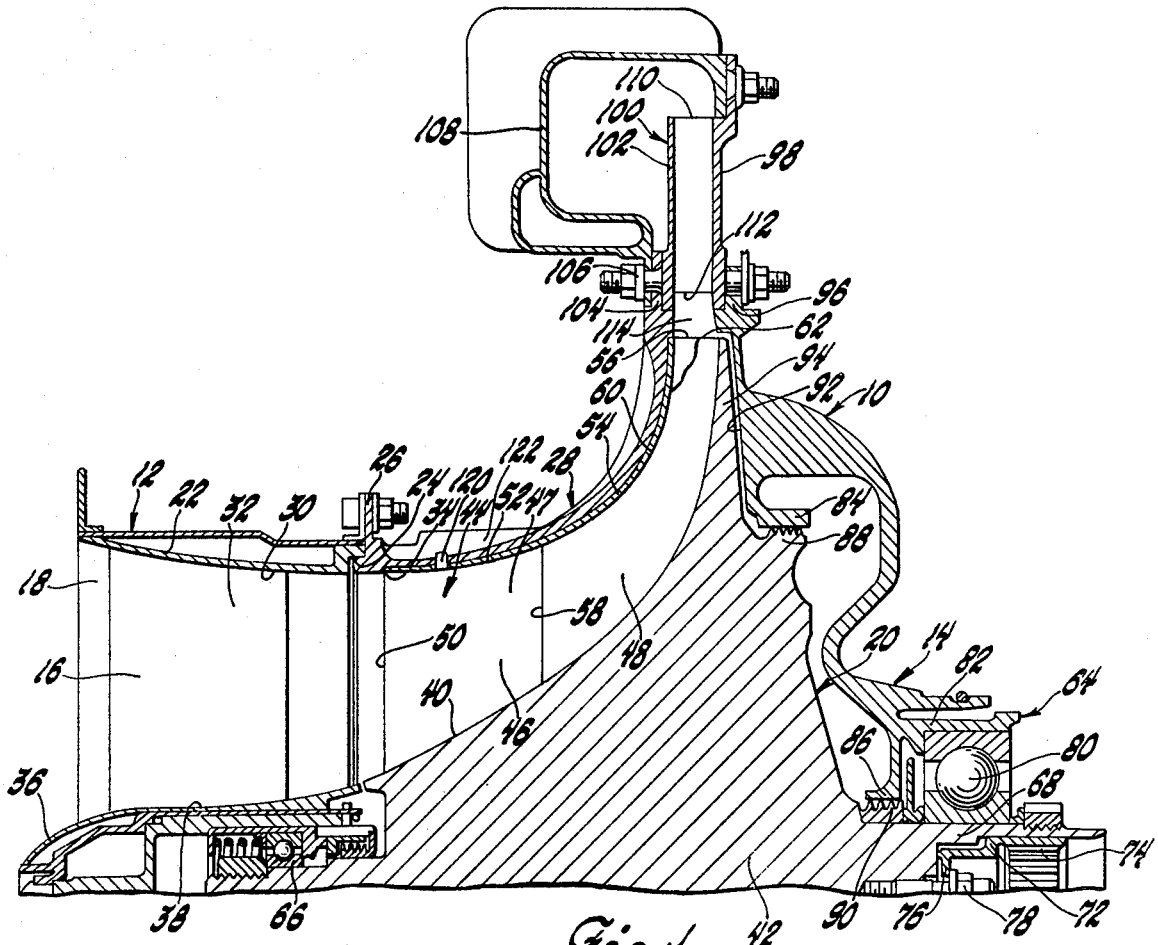
FIG. 1 is a fragmentary, longitudinal sectional view partially in elevation of a compressor including the present invention.
Figure 2:
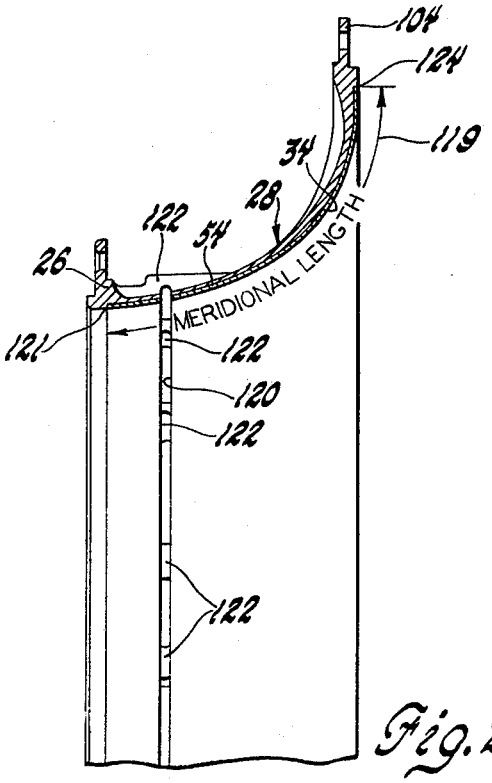
FIG. 2 is a fragmentary, sectional view through a portion of a stationary shroud cover in FIG. 1.
Figure 3:
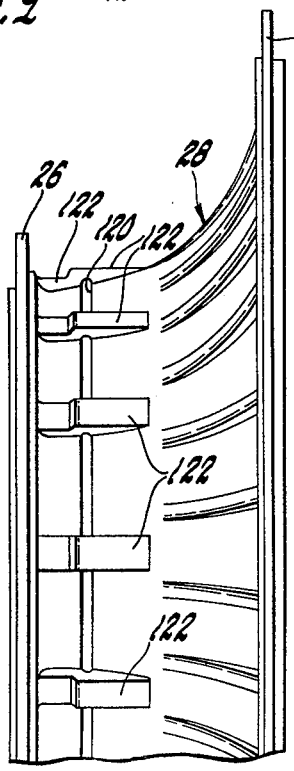
FIG. 3 is a fragmentary, enlarged elevational view of the shroud in FIG. 2.
Figure 4:
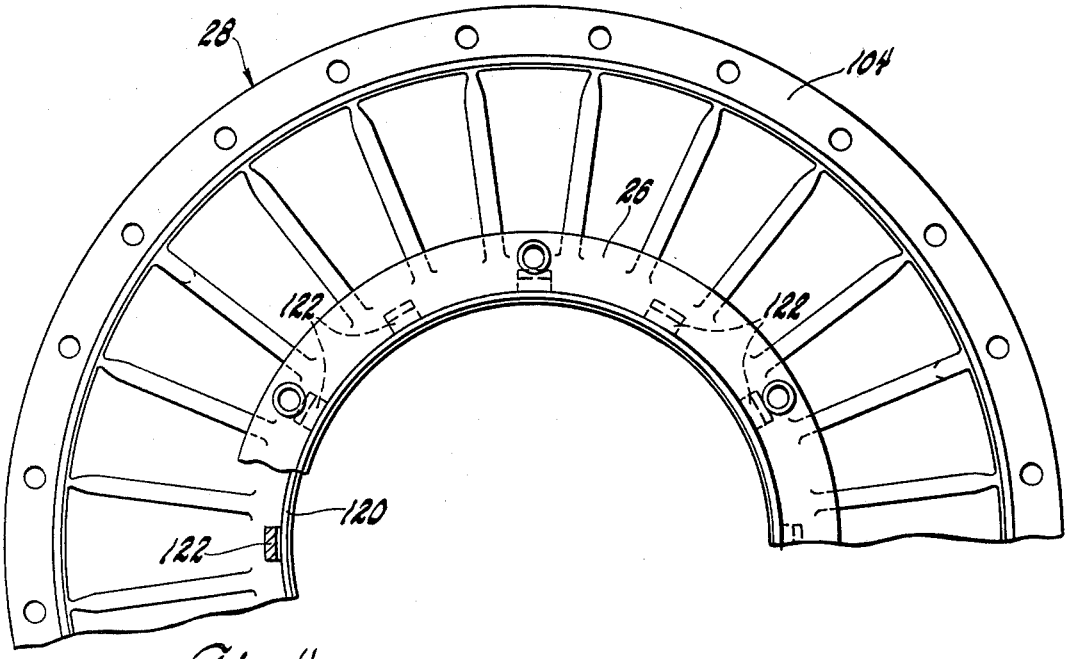
FIG. 4 is a front elevational view of the shroud cover of the present invention.

Referring now to the drawings, in FIG. 1 a compressor 10 is shown. It includes a front support assembly 12 and a rear support assembly 14 for physically locating the rotary components of the compressor 10 in a manner to be discussed. More particularly, the front support assembly 12 includes a plurality of circumferentially spaced axial struts 16 located in a generally radial direction across an annular inlet 18 to a rotor assembly 20 interposed between the front support assembly 12 and the rear support assembly 14. The front support assembly 12 includes an outer annular shroud wall 22 having a stepped shoulder 24 on the downstream end thereof that is piloted with respect to the forward flange 26 of a stationary compressor outer shroud housing 28. The front assembly shroud wall 22 has a contour that defines a smooth pathed outer surface 30 of an axially extending inlet flow path 32 that prevents abrupt flow changes upstream of a contoured inner surface 34 of the stationary compressor shroud housing 28. Likewise, the front support assembly 12 includes an internal hub portion 36 of conoidal form that defines a smooth transition to the inlet 18 and further defines a smooth contoured inner annular wall 38 that likewise avoids abrupt flow changes through the inlet flow path 32 to the contoured hub surface 40 on an impeller hub 42 of the rotor assembly 20. The airflow path through the assembly is thereby arranged to produce as uniform a flow distribution as possible from the inlet 18 to a flow inducer core 44 of the rotor assembly 20.

More particularly, the flow inducer core 44 is made up of a plurality of full length rotor impeller blades 46 having inducer passages 47 therebetween. A plurality of flow splitter blades 48 are also included on hub 42. Each of the full blades 46 includes a leading edge 50. The full blades 46 each have a radially outwardly located contoured tip 52 that follows the contour of the inner surface of a liner 54 of abradable aluminum compound that minimizes the operating clearance between the rotor assembly 20 and the inner surface of the stationary shroud housing 28. Likewise each of the full blades is bent back tangentially from the radial direction at an outlet radius 56 of the rotor assembly 20.

Each of the splitter blades 48 includes a leading edge 58 and a contoured radially outer tip 60 that is shaped to coincide with a contour of the liner 54. Each of the splitter blades is likewise bent back tangentially from the radial direction at the outlet radius 60 of the rotor assembly 20.

The rotor assembly 20 is fixed for rotation with respect to the inner contoured surface of the liner 54 by a rear bearing assembly 64 and a front bearing assembly 66. The rear bearing assembly 64 supportingly receives a rear hub extension 68 having a bore therethrough that receives a splined adapter 72 having internal spline teeth 74 thereon and an end portion 76 fixedly secured to the hub 42 by a suitable fastener represented by the illustrated screw and lock washer combination 78. A compressor drive shaft, not shown, can be coupled to the splined adapter 72 for driving the rotor assembly 20 during compressor operation. The rear bearing assembly 64 further includes a roller bearing 80 supported in a bearing support 82 of the rear support assembly 14. The support assembly 14 includes a pair of axially spaced abradable seal lands 84, 86 that cooperate with labyrinth seals 88, 90 on the impeller hub 42 to seal the internal gas flow path through the compressor assembly 10 from low pressure cavities within the compressor.

The rear support assembly 14 includes an internal surface 92 forming the back of the compressor rearwardly of the rear wall 94 of the impeller hub 42 as shown in FIG. 1. A pilot flange 96 on assembly 14 supports the rear wall 98 of a diffuser 100 configured to receive discharge flow from rotor assembly 20. More particularly, the diffuser 100 includes a front wall 102 that is secured to a pilot flange 104 on the outer radius of the stationary compressor shroud housing 28 by a plurality of fasteners 106 located at circumferentially spaced points around the shroud. Fasteners 106 further secure a discharge scroll collector 108 to the outlet 110 of the diffuser 100. The diffuser 100 includes a leading inlet edge 112 that is spaced to the outer radius of the rotor assembly 20 as shown in FIG. 1 to define an inlet region 114 in which shock wave patterns can develop to require matching the flow patterns through the rotor assembly 20 and those through the diffuser assembly 100.

The most crucial part of any high mach number diffuser is the inlet region or space 114. This quasivaneless region is complicated by the presence of shock waves therein and substantial sidewall boundary layer build up. In the present arrangement the diffuser 100 is correlated with respect to the high performance impeller characteristics including choke-to-surge operating ranges of the compressor 10, pressure recovery through the diffuser 100, and total pressure loss. Parameters that affect these variables include the number of diffuser passages, diffuser area ratio, diffuser passage length, leading edge to impeller tip radius ratio and the diffuser entry region geometry among others. While vaned diffusers are shown in the illustrated embodiment, the invention is equally applicable to any diffuser construction.

Figure 5:
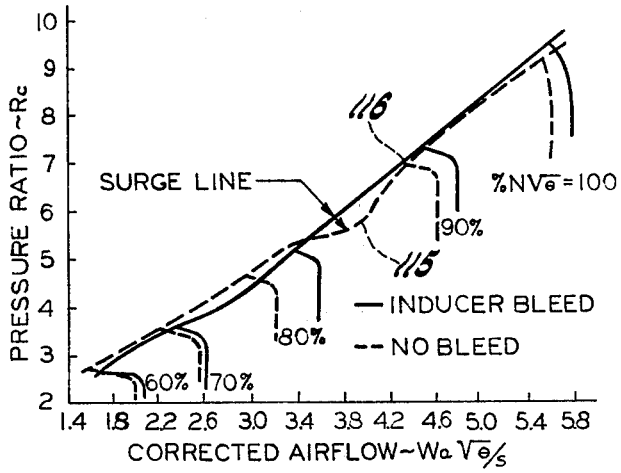
FIG. 5 is a performance chart of a compressor with and without the present invention.

In the FIG. 5 chart, compressor pressure ratio is plotted as a function of flow rate through the compressor with lines of constant rotational speed being superimposed thereon. The line connecting the left hand terminus of each of the illustrated speed lines is called the surge line and represents a limit of aerodynamically stable operation in centrifugal compressor and diffuser assemblies. The higher flow end of the surge line 116 is typically determined by stall within the diffuser of a compressor in a gas turbine engine, such as diffuser 100 illustrated in FIG. 1. The lower flow end of the surge line is typically determined by a combination of diffuser stall and stall within the inducer or inlet end of the rotor assembly 20. The low speed region in which the inducer leading edge 50 reaches stall conditions is frequently characterized by a dip in the surge line, shown at 115 in FIG. 5. In high pressure ratio stages, such a dip in the surge line may occur at a sufficiently high value of flow and speed of operation of the compressor to preclude energy efficient correction by means of a compressor discharge bleed valve system. Another way to relieve such problems where compressor discharge bleed is an unacceptable compromise of performance in a primary engine operating region is to relieve inducer stall by the location of an air bleed through holes or slots in the stationary cover over the inducer.

Figure 6:
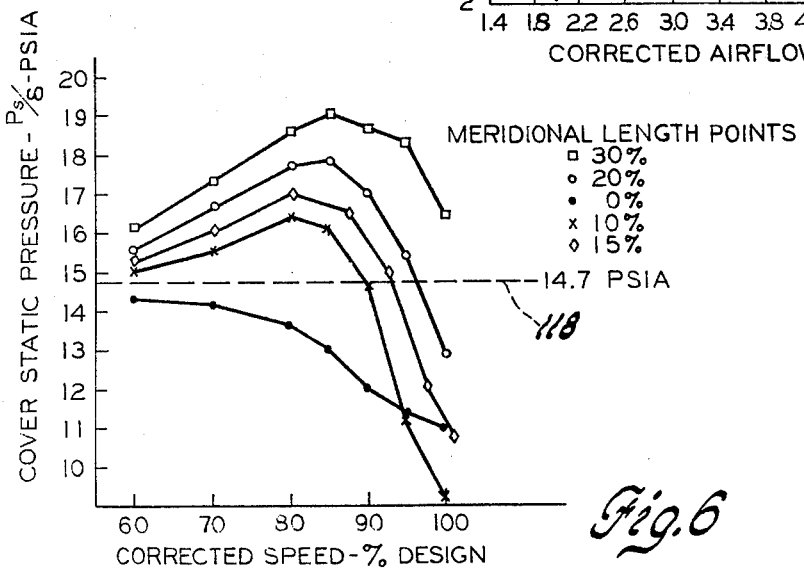
FIG. 6 is a chart of cover static pressure versus corrected speed of operation of the impeller in the compressor of FIG. 1.

FIG. 6 is a plot of static pressure measured at various meridional distances along the inner contoured surface 34 of the stationary compressor shroud housing 28 from the inlet to the exit thereof. The indicated static pressure measurements have been corrected to standard inlet conditions and are plotted as a function of compressor speed along an engine operating line.

Since the pressures have been corrected to standard conditions, a horizontal line 118 on the chart of FIG. 6 represents the pressure level of 14.7 psi, in this case considered to be an ambient condition. The preselected rotor assembly 20 and vaned diffuser 100, in the present invention are characterized as producing a given static pressure profile inside the cover at a meridional length 119 along the cover 28 with a zero percent point 121 at the leading edge of inducer 44 and its 100 percent point 124 at the exit edge 56. Low meridional distances are those near the point 121 just inside the shroud. Intermediate meridional distances are in the range of 10 to 15% of length 119. Higher meridional distances are in the range of 30% and above of length 119. At and above 30 percent of meridional length 119 static pressure is always greater than ambient under all impeller speeds up to and including the 100 percent design speed of operation of the rotor assembly 20. Accordingly, any bleed hole or slot located at the 30 percent meridional distance will cause outward air bleed from shroud 28 at all speeds of rotor operation. This type of bleed relieves inducer stall at low or part speed operating conditions of such rotor assemblies. In most cases such an application requires a valve operable to prevent bleed flow in the normal operating range of the engine. Otherwise, it has been observed that engine operating efficiency can be unduly compromised by wasting energy represented by the bleed flow when such bleed flow is not required.

Again referring to FIG. 6, the static pressure levels at the 15 percent meridional distance along the contoured surface 34 are both above and below 14.7 psia. Moreover, a continous slot 120 is located at the 15 percent meridional point on shroud 28 to produce an airflow which flows outwardly from within the inducer passages 47 to the exterior of the compressor 10 for all speeds up to approximately 95 percent of the design speed. Above 95 percent of the design speed of the rotor assembly, however, the pressure differential is actually reversed from outside of the compressor 10 to the inducer passages 47 at the contoured wall 34 thereof so that flow enters the inducer through a continuous bleed slot 120.

This inflow is important since inducers having the configuration of that illustrated in the present invention normally tend to limit flow capacity of a centrifugal compressor at and above 100 percent of its design speed with a vaned diffuser and at all speeds with conventional vaneless diffusers. Typically, such a throat or flow limiting restriction in the inducer is upstream of the illustrated 15 percent meridional distance location of slot 120. Accordingly, the potential of inbleed air through the bleed slot 120 downstream of the restriction throat in such an inducer of centrifugal compressors constitutes a way of adding high speed flow capacity to high performance centrifugal compressors. The high speed inbleed capability through the slot 120 further, may be used to decrease the annulus size of the annular inlet flow path 32 which, under part speed operating conditions, further improves the part speed stall and surge characteristics of such compressors.

In addition to improving the surge characteristics of a centrifugal compressor, location of cover shroud bleeds at a meridional point which recognizes the aforedescribed reversal of pressure differential across the stationary shroud cover 28. will also produce an improvement in compressor efficiency. At part speed conditions of operation where the inducer is actually changed from a stalled to an unstalled condition as a result of an outbleed of airflow, the efficiency change can be up to four percentage points above an arrangement without such bleed. At other conditions where the inducer was not stalled, however, there is still a substantial improvement in efficiency, presumably due to effects on the buildup of boundary layer on the inner surface 34 of the compressor shroud cover 28.

In the illustrated arrangement, the slot 120 is formed completely around the circumference of the shroud cover 28 at the previously discussed 15 percent meridional point. The slot is spanned by raised bridges 122 on the shroud cover 28 which serve to carry structural loads. If desired, separate holes in a circumferential row could replace slot 120 as long as desired bleed flow area is maintained.

The improved dual function control slot 120 or equivalent holes constitute a static device which, by virtue of its strategic location, produces variable flow patterns in a compressor for a gas turbine engine to extend its surge range and to improve its operating efficiency. The variability of bleed direction and improved results therefrom eliminates the need for control valves that close to prevent power reducing air loss when the surge control bleed is not required.

While the embodiments of the present invention, as herein disclosed, constitute a preferred form, it is to be understood that other forms might be adopted.

The embodiments of the invention in which an exclusive property or privilege is claimed are defined as follows:

1. A flow controlled gas compressor comprising: an annular stationary shroud with an inner wall having an inlet and an outlet with a meridional length therebetween, a rotor located within said shroud including a plurality of radially outwardly directed blades thereon, each including a leading edge, a trailing edge and an outer tip, said outer tip being free and located in close spaced relationship to said inner wall, pressure generating means including said rotor for producing a static pressure just inside the shroud at low meridional distances in the range of 0%–5% of the meridional length which is less than ambient pressure at all speeds of the rotor and also for producing a static pressure level at higher meridional distances greater than 30% of the meridional length which is higher than ambient pressure at all speeds of the rotor, said pressure generating means including said rotor being operative to produce a static pressure level at an intermediate meridional distance on said inner wall in the range of 5%–25% of the meridional length which is greater than ambient pressure in the part speed range of operation of said rotor and less than ambient pressure at the same intermediate meridional distance at speeds of operation higher than the part speed range, and a bleed hole located through said shroud at the intermediate meridional distance on said inner wall and in communication with ambient air, said bleed hole at rotor speeds above the part speed range of operation allowing inflow of ambient air through said bleed hole to add to total inlet flow to said rotor for increased flow capacity of said rotor under high speed conditions of operation, said bleed hole serving to bleed air flow from the rotor of said compressor to ambient air at part speed range of operation thereof to flow stabilize the compressor at part speed phases of operation thereof.

2. A flow controlled gas compressor comprising: an annular stationary shroud with an inner wall having an inlet and an outlet with a meridional length therebetween, a rotor located within said shroud including a plurality of radially outwardly directed blades thereon, each including a leading edge, a trailing edge and an outer tip, said outer tip being free and located in close spaced relationship to said inner wall, pressure generating means including said rotor for producing, a static pressure just inside the shroud at a low meridional distance in the range of 0%–5% of the meridional length which is less than ambient pressure at all speeds of the rotor and also for producing a static pressure level at higher meridional distances greater than 30% of the meridional length which is higher than ambient at all speeds of the rotor, said pressure generating means including said rotor being operative to produce a static pressure level at an intermediate meridional point on said inner wall in the range of 5%–25% of the meridional length which is greater than ambient pressure in the part speed range of operation of said rotor and less than ambient pressure at the same intermediate meridional distance at higher speeds of operation, and a bleed slot located through said shroud at the intermediate meridional distance on said inner wall and in communication with ambient air, said shroud bleed slot being formed as an annulus circumferentially along the inner surface of said shroud and extending radially outwardly therethrough, a plurality of circumferentially spaced bridge segments on said shroud spanning across the bleed slot to allow unrestricted gas flow therethrough and to reinforce the shroud at the bleed control slot therein, said bleed slot at rotor speeds above the part speed range of operation allowing inflow of ambient air through said bleed slot to add to total inlet flow to said rotor for increased flow capacity of said rotor under high speed conditions of operation, said bleed slot serving to bleed air flow from the rotor of said compressor to ambient air at part speed range of operation thereof to flow stabilize the compressor at part speed phases of operation thereof.

3. A flow controlled gas compressor comprising: an annular stationary shroud with an inner wall having an inlet and an outlet with a meridional length therebetween, a rotor located within said shroud including a plurality of radially outwardly directed blades thereon, each including a leading edge, a trailing edge and an outer tip, said outer tip being free and located in close spaced relationship to said inner wall, pressure generating means including said rotor for producing a static pressure just inside the shroud at a low meridional distance in the range of 0%–5% of the meridional length which is less than ambient pressure at all speeds of the rotor and also for producing a static pressure level at higher meridional distances greater than 30% of the meridional length which is higher than ambient at all speeds of the rotor, said pressure generating means including said rotor being operative to produce a static pressure level at an intermediate meridional distance on said inner wall in the range of 5%–25% of the meridional length which is greater than ambient pressure in the part speed range of operation of said rotor, and less than ambient pressure at the same intermediate meridional distance at higher speeds of operation, bleed holes located in said shroud at the intermediate meridional distance on said inner wall, said shroud bleed holes being formed as a circumferential row in the inner surface of said shroud and extending radially outwardly therethrough, said bleed holes at rotor speeds above the part speed range of operation allowing inflow of ambient air through said bleed holes to add to total inlet flow to said rotor for increased flow capacity of said rotor under high speed conditions of operation, said bleed holes serving to bleed air flow from the rotor of said compressor to ambient air at part speed range of operation thereof to flow stabilize the compressor at part speed phases of operation thereof.

* * * * *